US012687000B2

(12) United States Patent
Castellote

(10) Patent No.: US 12,687,000 B2
(45) **Date of Patent: *Jul. 21, 2026**

(54) JOINT DEVICE FOR DRAIN PIPES

(71) Applicant: C.G. AIR SYSTÈMES INC., Ste-Marguerite (CA)

(72) Inventor: Miguel Castellote, Ste-Marguerite-de-Dorchester (CA)

(73) Assignee: C.G. AIR SYSTÈMES INC., Ste-Marguerite (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/920,215

(22) Filed: Oct. 18, 2024

(65) Prior Publication Data

US 2025/0043554 A1 Feb. 6, 2025

Related U.S. Application Data

(63) Continuation of application No. 17/574,735, filed on Jan. 13, 2022, now Pat. No. 12,152,379, which is a (Continued)

(30) Foreign Application Priority Data

Jan. 26, 2016 (CA) ..... 2919043

(51) Int. Cl.
*E03C 1/22* (2006.01)
*E03C 1/20* (2006.01)
(Continued)

(52) U.S. Cl.
CPC ..... *E03C 1/22* (2013.01); *E03C 1/20* (2013.01); *E03C 1/284* (2013.01); *E03F 5/0407* (2013.01); *E03F 2005/0416* (2013.01)

(58) Field of Classification Search
CPC ..... F16L 21/03; F16L 21/04; F16L 17/025; F16L 25/10; F16L 25/14; F16L 41/08; (Continued)

(56) References Cited

U.S. PATENT DOCUMENTS 3,314,086 A * 4/1967 Minella
3,400,954 A 9/1968 Brown
(Continued)

FOREIGN PATENT DOCUMENTS

CA 2813010 A1 9/2014
DE 102005044304 A1 4/2006
EP 0311296 A1 4/1989

OTHER PUBLICATIONS

Chris Deziel, How to Install a Bathtub P-Trap, Oct. 9, 2014, Demand Media, pp. 1-4 (Year: 2014).

*Primary Examiner* — William S. Choi
(74) *Attorney, Agent, or Firm* — NORTON ROSE FULBRIGHT CANADA LLP

(57) ABSTRACT

A joint device for drain pipes comprises a structural tube made of a rigid material and providing structural integrity to the joint device. The structural tube defines at least part of a drain passage of the joint device, a bottom portion of the structural tube having diametrical dimensions for complementary sealing engagement with a pipe of a drain network. An annular seal of resilient sealing material is integrally connected to an upper portion of the structural tube to define at least an inner surface of a portion of the drain passage of the joint device, the annular seal having inner diametrical dimensions for sealing engagement with a tailpiece slid downwardly into engagement with the joint device.

20 Claims, 7 Drawing Sheets

Related U.S. Application Data continuation of application No. 15/255,834, filed on Sep. 2, 2016, now Pat. No. 12,110,671.

(60) Provisional application No. 62/213,194, filed on Sep. 2, 2015.

(51) Int. Cl.
*E03C 1/284* (2006.01)
*E03F 5/04* (2006.01)

(58) Field of Classification Search
CPC ..... F16L 41/086; F16L 47/26; F16L 47/28; E03C 1/22; E03C 1/20; E03C 1/284; E03F 5/0407; E03F 2005/0416
USPC ..... 285/56
See application file for complete search history.

(56) References Cited

U.S. PATENT DOCUMENTS

| | | | | |
|---|---|---|---|---|
| 3,913,928 | A | 10/1975 | Yamaguchi | |
| 3,998,478 | A | 12/1976 | Zopfi | |
| 4,207,632 | A * | 6/1980 | Savell, Jr. | |
| 4,664,421 | A | 5/1987 | Jones | |
| 4,915,422 | A | 4/1990 | Chacon et al. | |
| 6,341,391 | B1 * | 1/2002 | Cheng | |
| 6,519,784 | B2 | 2/2003 | Carwile | |
| 6,634,034 | B2 | 10/2003 | Rendell | |
| 7,155,760 | B2 | 1/2007 | McAlpine | |
| 7,621,002 | B1 | 11/2009 | Helmstetter et al. | |
| 2003/0051343 | A1 * | 3/2003 | Ball | E03C 1/22 |
| 2006/0253971 | A1 | 11/2006 | Colin et al. | |
| 2009/0295102 | A1 | 12/2009 | McKenzie | |
| 2010/0133804 | A1 | 6/2010 | Larkin | |
| 2013/0283518 | A1 * | 10/2013 | Ciechanowski | |
| 2021/0047816 | A1 * | 2/2021 | Pilarczyk | E03C 1/20 |

* cited by examiner

JOINT DEVICE FOR DRAIN PIPES

CROSS-REFERENCE TO RELATED APPLICATIONS

The present application is a continuation of U.S. patent application Ser. No. 17/574,735, that is a continuation of U.S. Pat. No. 12,110,671, that claims priority of U.S. Patent Application No. 62/213,194, filed on Sep. 2, 2015, and Canadian Application No. 2,919,043, filed on Jan. 26, 2016, and incorporated herein by reference.

FIELD OF THE APPLICATION

The present application relates to drain piping and more particularly to joints between drain pipes.

BACKGROUND OF THE ART

Typical drain systems, whether used in baths, showers, sinks or other types of vessels, have detachable pipes to enable maintenance. For instance, P-traps are conventionally used as a way to prevent odor infiltration. However, access to P-traps is often necessary as a trap may become clogged.

A commonly used piping configuration features a nut on a lower pipe, which nut is tightened or loosened to an upper pipe (known as a tailpiece) to create or release a join therebetween. However, such nut may be difficult to access, whether it be from under a sink, from the floor or the ceiling of a lower level. In the latter case, it may often be necessary to access the drain via holes in drywall ceilings to access the plumbing, to have space to access the nut with sufficient clearance to manipulate a wrench.

SUMMARY OF THE APPLICATION

It is therefore an aim of the present disclosure to provide a joint device for drain pipes that addresses issues related to the prior art.

Therefore, in accordance with the present application, there is provided a joint device for drain pipes comprising: a structural tube made of a rigid material and providing structural integrity to the joint device, the structural tube defining at least part of a drain passage of the joint device, a bottom portion of the structural tube having diametrical dimensions for complementary sealing engagement with a pipe of a drain network; and an annular seal of resilient sealing material integrally connected to an upper portion of the structural tube to define at least an inner surface of a portion of the drain passage of the joint device, the annular seal having inner diametrical dimensions for sealing engagement with a tailpiece slid downwardly into engagement with the joint device.

Further in accordance with the present disclosure, there is provided an assembly comprising: the joint device as described above, and a tailpiece having an outer diameter sized for sealing engagement with the annular seal when slid into engagement with the joint device.

The assembly may also comprise a drain base having a support portion for bring attached to a periphery of a drain hole, a tube portion for receiving and supporting the joint device and blocking the joint device from moving downwardly.

The assembly may also comprise a cover secured to the drain base, the cover abutting against the joint device to block the joint device from moving upwardly.

Further in accordance with the present disclosure, there is provided a method for installing a drain assembly comprising: forming a permanent sealed joint between a joint device and an upwardly-open pipe of a pipe network; and completing a sealing interconnection between a tailpiece and the joint device by sliding the tailpiece through a drain hole into an open top end of a drain passage of the joint device to form a sealing engagement between an annular seal integral to the joint device and an outer diameter of the tailpiece.

DESCRIPTION OF THE PREFERRED EMBODIMENTS

Figure 1:
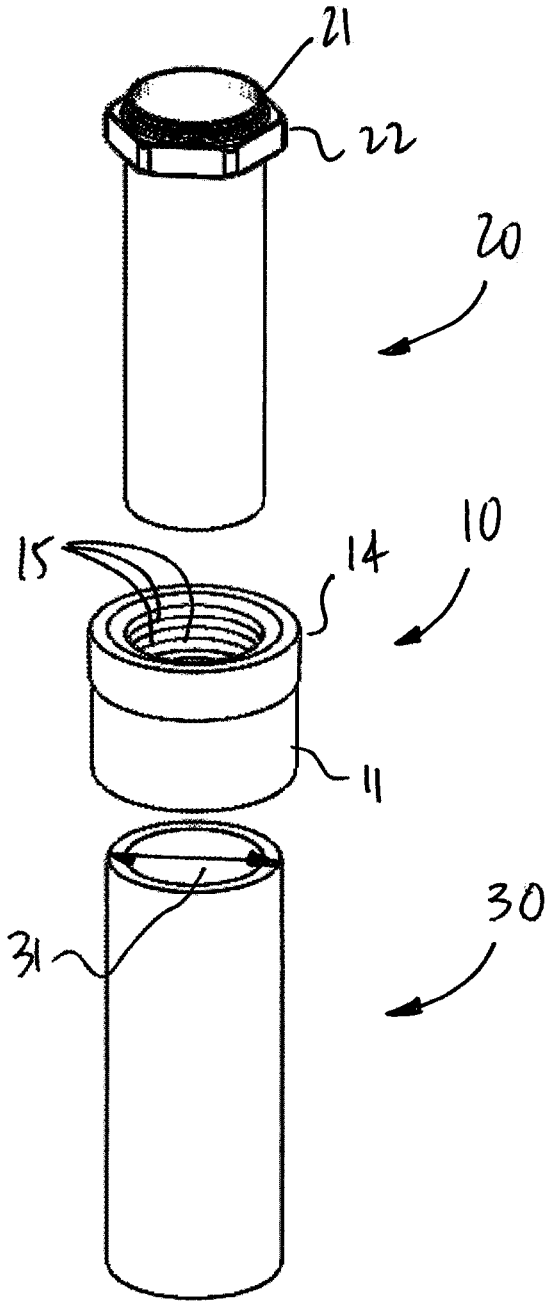
FIG. 1 is a perspective view of a joint device between a top drain pipe and a lower drain pipe, in accordance with the present disclosure.
Figure 2:
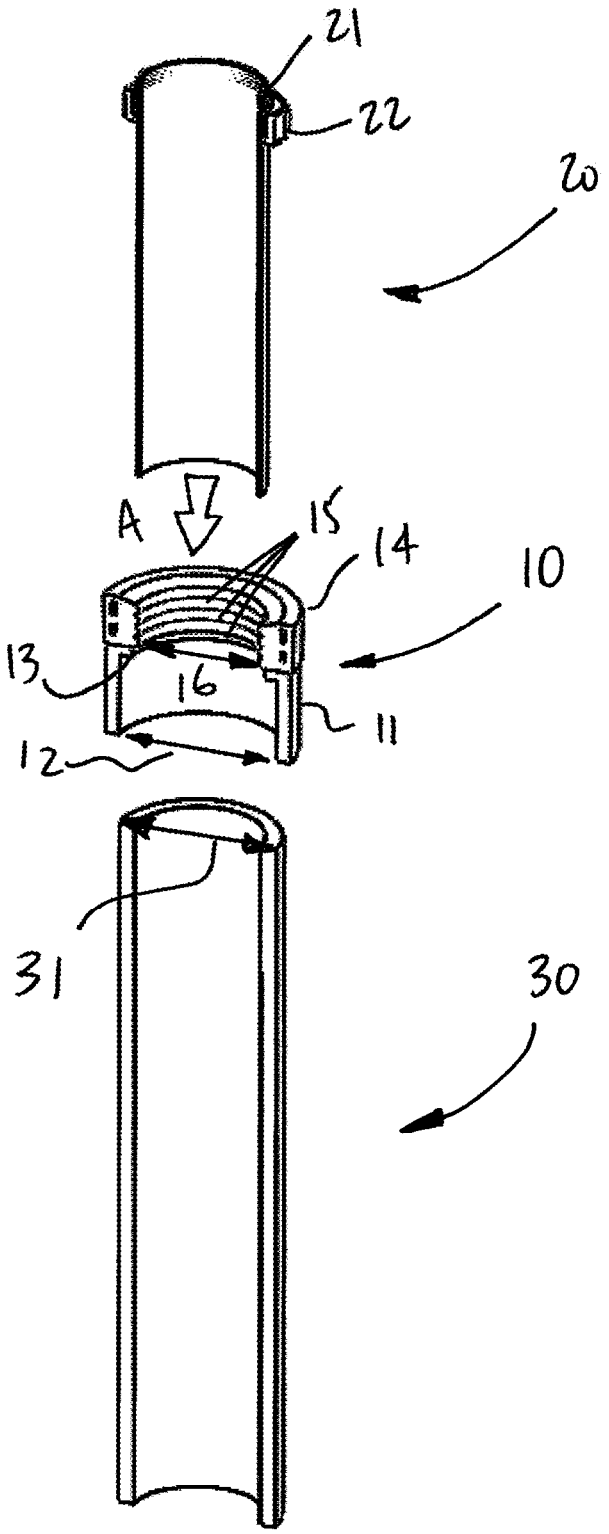
FIG. 2 is a section perspective view of the assembly of FIG. 1.

Referring to drawings and more particularly to FIGS. 1 and 2, there is illustrated a joint device 10 in accordance with the present disclosure, used to join a top drain pipe 20, often referred to as a tailpiece of a drain, to a lower drain pipe 30. The joint device 10 is devised to form a waterproof joint with the top drain pipe 20 and the lower drain pipe 30.

The top drain pipe or tailpiece 20 is of the type that emerges at a drain hole, whether it be in a drain of a shower, a tub, a bath, a sink or any other vessel.

The lower drain pipe 30 is of the type that is connected to a drain network in any appropriate fashion, to direct drained fluid to a sewer system, to a septic tank, etc.

Figure 6:
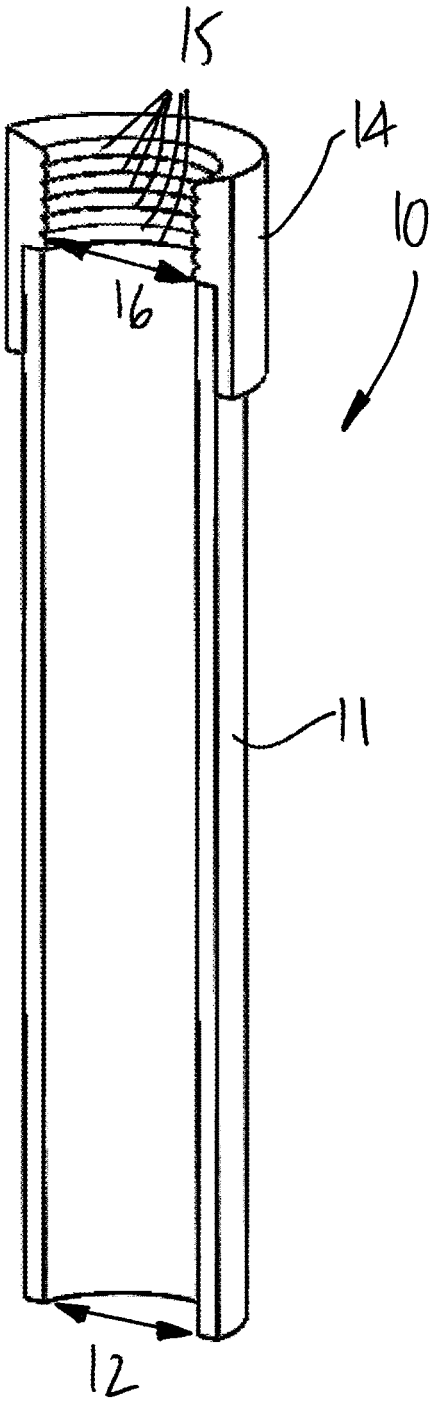
FIG. 6 is a perspective view of the joint device of FIG. 1, with an extended length.

The joint device 10 has a tubular body constructed with a structural tube 11. The structural tube 11 provides the structural integrity to the joint device 10. The structural tube 11 may for example be made of ABS (acrylonitrile butadiene styrene, e.g., ASTM D2661-14 or equivalent), PVC (polyvinyl chloride, e.g., ASTM D2665-14 or equivalent) or other rigid structural materials such as polymers or metals. The selection of the material of the structural tube 11 is depend on that of the drain network, as the structural tube 11 will be permanently secured to the drain network. Moreover, depending on the application, the structural tube 11 may have different lengths. FIGS. 1 and 2 show a shorter length, by which the joint device 10 is at the interface between the tailpiece 20 and the lower drain pipe 30. The structural tube 11 may be longer, as shown in FIG. 6, for the joint device 10 to be directly connected to a network component such as a P-trap, without the necessity for the lower drain pipe 30. The length of the joint device 10 may depend on user preference, or on available space, etc.

The structural tube 11 is also the interface of the joint device 10 with the lower drain pipe 30 or other component of a drain network, such as a P-trap. As observed in FIG. 2, the structural tube 11 has an inner diameter 12. The structural tube 11 may also have an inner shoulder 13 that is part of a flange, distanced from a bottom edge of the structural tube 11, although it is contemplated to use the structural tube 11 without the flange and inner shoulder 13. The joint device 10 further comprises an annular seal 14 that is integrally connected to the structural tube 11. The annular seal 14 is made of a rubber or polymer that is resilient (i.e., it elastically deforms and is compliant) and offers some sealing waterproof properties. According to an embodiment, the annular seal 14 may be overmolded in that it results from a molding process by which the material of the annular seal 14 is molded over the structural tube 11 that was previously molded. Other techniques may include gluing the annular seal 14 on top of the structural tube 11. In any event, the structural tube 11 and the annular seal 14 form an integral inseparable piece, in that the annular seal 14 cannot be removed from the structural tube 11, without excessive force or without tools that rip the seal 14 away. As shown in the figures, the annular seal 14 may completely encapsulate the upper portion of the structural tube 11.

The annular seal 14 may have one or more inner annular ribs 15 in the illustrated embodiment. It is however considered to provide the annular seal 14 with a smooth inner wall instead of the inner ribs 15. As also observed from FIG. 2, the inner diameter 12 of the structural tube 11 is of greater dimension than an inner diameter 16 of the annular seal 14. The structural tube 11 and the annular seal 14 concurrently define an inner drain passage of the joint device 10, through which fluids circulate during draining.

The top drain pipe or tailpiece 20 is shown as having threading 21 and a nut 22 thereon, as one possible connection system for the top drain pipe 20 to be hung or attached to the walls or periphery of a drain hole. Other connection arrangements are considered for the tailpiece 20, such as a flange. The tailpiece 20 is typically made of brass, although other materials may be used as well.

Still referring to FIGS. 1 and 2, the interaction of the joint device 10 with the top drain pipe 20 and the lower drain pipe 30 is illustrated. An outer diameter of the top drain pipe 20 is smaller than the inner diameter 12 of the joint device 10, but is equivalent or slightly larger than the inner diameter 16 of the annular seal 14. Accordingly, the top drain pipe 20 may be slid into an engagement with the joint device 10 manually along a downward direction A, however with some friction between the annular seal 14 (e.g., the inner ribs 15) and the outer surface of the drain pipe 20. In the insertion step along direction A, the annular seal 14 may typically deform by way of its resilience to form a waterproof joint with the drain pipe 20. Moreover, the friction between the annular seal 14 and the drain pipe 20 is such that a retaining force is present between the joint device 10 and the drain pipe 20, such that the drain pipe 20 may not be accidentally dislodged from engagement. The sealing engagement between the joint device 10 and the drain pipe 20 has sufficient friction to rely solely on this sealing engagement to complete the assembly therebetween, i.e., no additional step of bonding is required between the joint device 10 and the drain pipe 20.

In an embodiment, some upward manual pull in a direction opposite to A is required to withdraw the drain pipe 20 from engagement with the joint device 10. It is also observed that the depth of insertion of the drain pipe 20 into the joint device 10 may not be limited other than by the connection components at the top of the drain pipe 20. However, whatever the depth of insertion is for the drain pipe 20 in the joint device 10, the waterproof joint is formed when a bottom portion of the drain pipe 20 is in contact with the annular seal 14.

The lower drain pipe 30 has an outer diameter 31 that is complementary to that of the inner diameter 12 of the structural tube 11, for mating engagement therebetween. However, it may be the other way around, with the joint device 10 matingly inserted in the lower drain pipe 30, instead of the opposite. In accordance with an embodiment, the inner diameter 12 of the structural tube 11 and the outer diameter 31 are dimensioned according to piping standards for a waterproof seal to be formed upon connection of the joint device 10 and lower drain pipe 30. According to an embodiment, the lower drain pipe 30 is made of ABS or PVC as is the structural tube 11 of the joint device 10, such that a waterproof joint is formed when the joint device 10 is inserted on the lower drain pipe 30, and a sealant such as a glue or cement is used to secure the joint device 10 to the lower drain pipe 30. Accordingly, the joint device 10 bonded to the lower drain pipe 30 forms a permanent or semi-permanent bond. It is also observed that the inner shoulder 13 may act as an abutment to limit the depth of insertion of the joint device 10 on the lower drain pipe 30. Alternatively, in the absence of a flange with shoulder 13, the lower depth of insertion could be limited by a bottom edge of the annular seal 14.

Although the interconnection between the joint device 10 and the lower drain pipe 30 has been described, the joint device 10 may be directly connected in the same manner to other components of a drain network, such as a pipe or a P-trap, instead of being connected indirectly to the drain network via the lower drain pipe 30.

Figure 3:
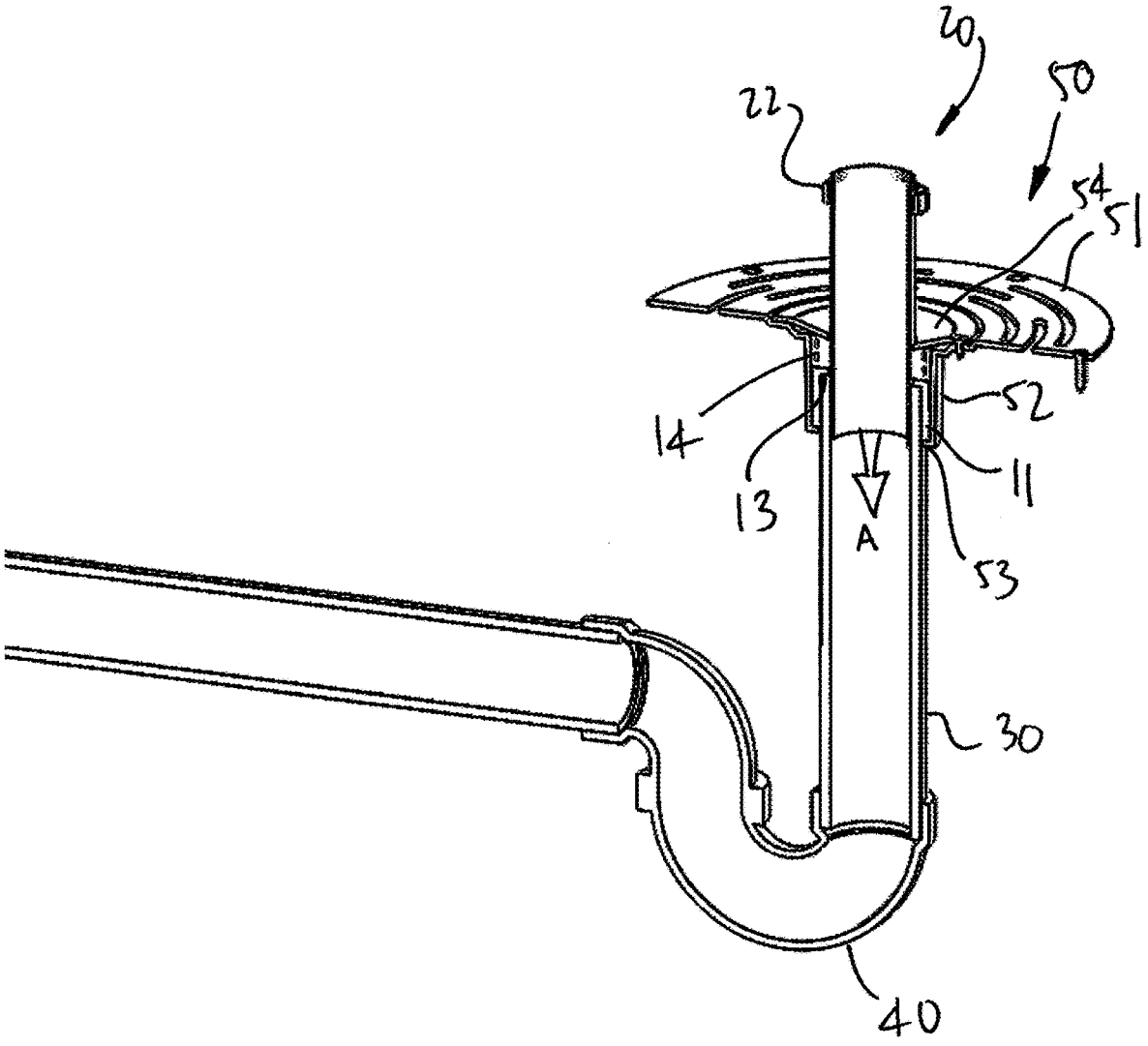
FIG. 3 is a perspective view of the assembly of FIG. 1 relative to a drain and P-trap.
Figure 4:
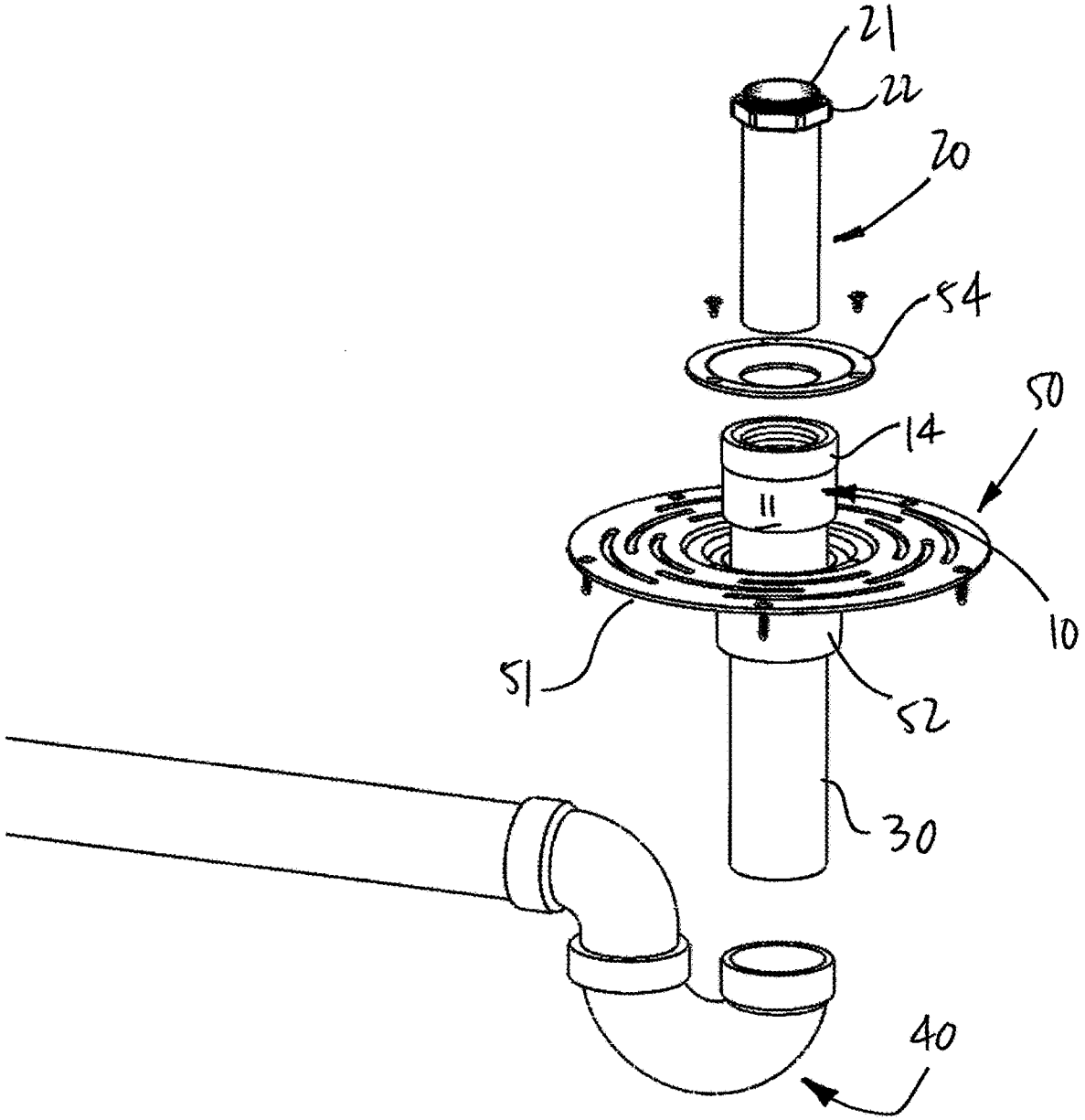
FIG. 4 is an assembly view of the assembly of FIG. 1 between a drain and a P-trap.

Referring to FIGS. 3 and 4, an exemplary embodiment of the installation of the assembly of FIGS. 1 and 2 at a drain hole is shown. The joint device 10, the tailpiece 20 and lower drain pipe 30 are shown as being connected to a P-trap 40 and to a drain kit 50. The P-trap 40 may also be known as a trap, a J-trap, an S-trap or a S-bend, among other names.

The drain kit 50 has a drain base or support 51 that is secured to a periphery of a drain hole, such as to the floor, or vessel bottom, for instance by way of screws. The drain base 51 is conventionally sealed to the periphery of the drain hole. The drain base 51 has a support tube 52 from which a flange with shoulder 53 projects inwardly. The support tube 52 is sized for close fitting engagement of the joint device 10 therein, such that the joint device 10 may be deposited and supported by the shoulder 53. Therefore, when the tailpiece 20 is slid into the joint device 20 by downward force, the drain base 51 absorbs the downward force and distributes it to the floor to vessel bottom. The joint device 10, when received in the support tube 52, is also connected to a top of the lower drain pipe 30, in the manner described above, with a suitable sealant forming a permanent bond between the joint device 10 and the lower drain pipe 30.

Figure 5:
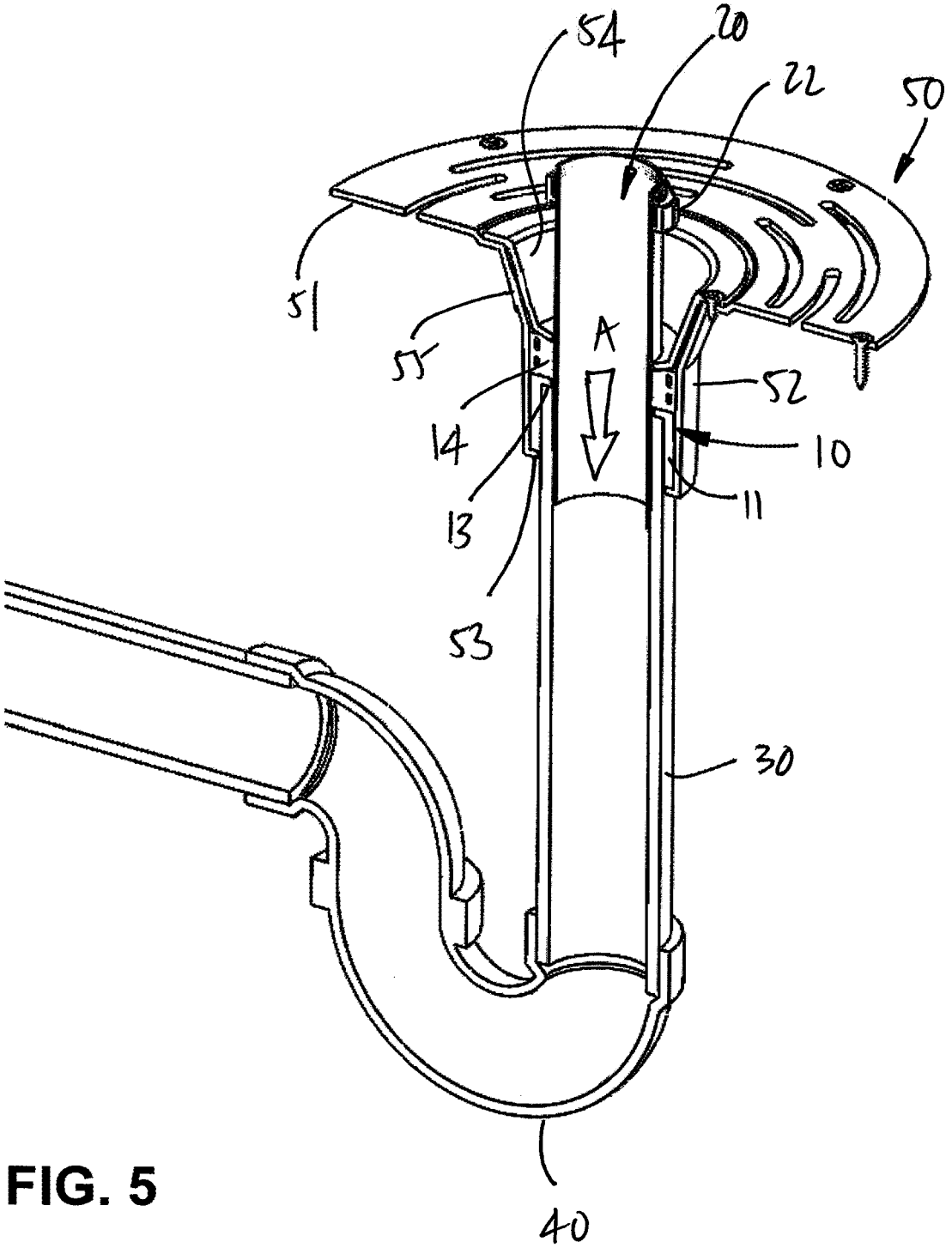
FIG. 5 is a perspective view of the assembly of FIG. 1 between a drain and a P-trap in accordance with another embodiment.

Once the joint device 10 is joined with the lower drain pipe 30 and installed in the support tube 52 of the drain base 51, the tailpiece 20 may be slid into sealing engagement with the joint device 10, along direction A. The tailpiece 20 is slid downwardly until the nut 22 or like connector abuts against the joint device 10, or part of the drain kit 50. The downward sliding movement may simply result from a manually applied force, without any tools. A strainer or cover 54 (e.g., funnel shaped) may then be fitted over the top of the top drain pipe 20 after the top drain pipe 20 has been slid into an engagement with the joint device 10, with fasteners such as screws securing the assembly. Accordingly, the cover 54 may block the joint device 10 from moving upwardly when the top drain pipe 20 is being pulled out of engagement with the joint device 10. Although not shown, the cover 54 may have a strainer portion to block larger objects from being drained away. FIG. 5 shows a similar arrangement, however with the support tube 52 having a countersink portion 55.

Figure 7:
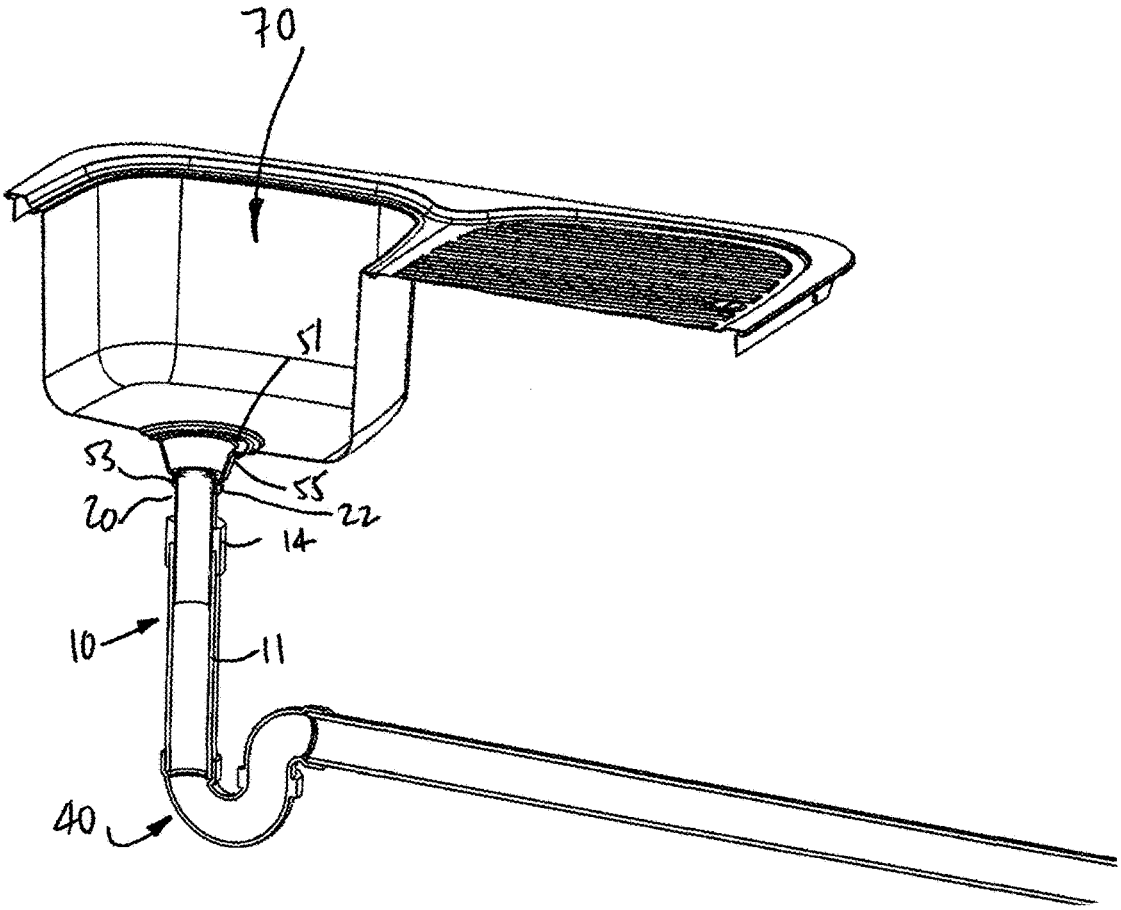
FIG. 7 is a perspective view of the joint assembly of FIG. 1, with an extended length of the joint device, as assembled to a sink.

Referring to FIG. 7, a sink 70 is shown with some of the afore-mentioned components. The joint device 10 is of extended length, such that it is connected directly to the P-trap 40, without an intermediary lower drain pipe 30.

Accordingly, a method for installing the drain assembly of the present disclosure comprises forming a permanent sealed joint between the joint device 10 and a top portion of a pipe 30 or 40 of a pipe network. The method further comprises sliding the tailpiece 20 through a drain hole into an open top end of a passage of the joint device 10 to form a seal between the annular seal 14 integral to the joint device 10 and an outer diameter of the tailpiece 20. In doing so, the sealing interconnection between the tailpiece 20 and the joint device 10 is complete, in that no other intervention is required between the joint device 10 and the tailpiece 20 to complete the sealing engagement (e.g., no additional securing step). The tailpiece 20 may be secured to the surrounding of the drain hole, but that does not affect the sealing engagement between the joint device 10 and the tailpiece 20.

The invention claimed is:

1. An assembly comprising:

a joint device including a structural tube made of a rigid material and providing structural integrity to the joint device, the structural tube defining at least part of a drain passage of the joint device, a bottom portion of the structural tube having diametrical dimensions for direct complementary abutment sealing engagement with a pipe of a drain network, and an annular seal of resilient sealing material inseparably connected to an inner diameter of an upper portion of the structural tube to define at least an inner surface of a portion of the drain passage of the joint device, the annular seal having inner diametrical dimensions configured for sealing engagement with a tailpiece slid downwardly into engagement with the joint device; and a drain base having a support portion for being attached to a periphery of a drain hole, a tube portion for receiving and supporting the joint device and blocking the joint device from moving downwardly.

2. The assembly according to claim 1, including the tailpiece.

3. The assembly according to claim 2, wherein the tailpiece has an outer diameter sized for penetrating the drain passage and for sealing engagement with the annular seal when slid into engagement with the joint device, an inner diameter of the bottom portion of the structural tube being larger than the outer diameter of the tailpiece, the outer diameter of the tailpiece being smaller than an inner diameter of the pipe of the drain network.

4. The assembly according to claim 2, wherein the tailpiece has an enlarged portion at a top end for being hung in the assembly.

5. The assembly according to claim 1, wherein the direct complementary abutment sealing engagement between the pipe and the joint device extends along a majority of a depth of insertion of the pipe in the joint device.

6. The assembly according to claim 1, wherein the support portion of the drain base lies against the periphery of the drain hole.

7. The assembly according to claim 1, including the pipe of the drain network.

8. The assembly according to claim 7, wherein an inner diameter of the pipe is larger than the outer diameter of a bottom portion of the tailpiece.

9. The assembly according to claim 7, wherein the pipe has a constant outer diameter all along the direct complementary abutment sealing engagement with said joint device.

10. The assembly according to claim 1, wherein the inner surface defined by the annular seal comprises annular ribs.

11. The assembly according to claim 1, wherein the inner surface of the upper portion of the structural tube has the annular seal, and the inner surface of the bottom portion of the structural tube is without the annular seal.

12. The assembly according to claim 11, wherein an inner diameter of the drain passage is larger at said bottom portion than at said upper portion and wherein the inner diameter of the bottom portion of the structural tube is larger than the outer diameter of said pipe.

13. The assembly according to claim 1, wherein the annular seal completely encapsulates the upper portion of the structural tube.

14. The assembly according to claim 1, wherein the structural tube further comprises an inwardly projecting flange spaced apart from a bottom edge thereof.

15. The assembly according to claim 1, wherein the structural tube is made of polyvinyl chloride or acrylonitrile butadiene styrene.

16. The assembly according to claim 1, wherein the annular seal is an overmold annular seal connected to the structural tube.

17. The assembly according to claim 1, further comprising a cover secured to the drain base, the cover abutting against the joint device to block the joint device from moving upwardly.

18. The assembly according to claim 1, wherein the joint device is a single component configured for interfacing the tailpiece to the pipe of the drain network.

19. The assembly according to claim 1, wherein the direct complementary abutment sealing engagement between the pipe and the joint device extends along a majority of a depth of insertion of the pipe in the joint device.

20. A method for installing a drain assembly, the method comprising:

sliding a structural tube of a joint device into sealing engagement over a top end portion of a drain pipe aligned with a drain hole in a floor, the joint device being a removable insert within a support tube of a drain base and having a structural tube and an annular seal of resilient sealing material integral to and inseparably joined to a top end portion of the structural tube, whereby the support tube of the drain base is received in the drain hole, and a flange of the drain base rests on the floor around the drain hole;

securing the flange of the drain base to the floor; and sliding a tailpiece by downward force through the drain hole into the joint device to form a sealing engagement between the annular seal of the joint device and an outer diameter of the tailpiece.

* * * * *